US005372857A

United States Patent [19]

Browning

[11] Patent Number: 5,372,857

[45] Date of Patent: Dec. 13, 1994

[54] METHOD OF HIGH INTENSITY STEAM COOLING OF AIR-COOLED FLAME SPRAY APPARATUS

[76] Inventor: James A. Browning, P.O. Box 6, Hanover, N.H. 03755

[21] Appl. No.: 992,132

[22] Filed: Dec. 17, 1992

[51] Int. Cl.[5] ..... B05D 1/08

[52] U.S. Cl. ..... 427/446; 239/79; 239/83; 427/449

[58] Field of Search ..... 427/446, 449; 239/79, 239/80, 82, 83, 85, 132.3

[56] References Cited

U.S. PATENT DOCUMENTS

| | | | |
|---|---|---|---|
| 3,880,354 | 4/1975 | Van Horn | 239/132.3 |
| 4,235,943 | 11/1980 | McComas et al. | 427/446 |
| 4,369,919 | 1/1983 | Bebev et al. | 239/79 |
| 4,634,611 | 1/1987 | Browning | 439/81 |
| 5,135,166 | 8/1992 | Dietiker et al. | 239/79 |

*Primary Examiner*—Shrive Beck
*Assistant Examiner*—Katherine A. Barford
*Attorney, Agent, or Firm*—Sughrue, Mion, Zinn, Macpeak & Seas

[57] ABSTRACT

A flame spray device of the internal burner type has a fuel and oxidizer mixture combusted within a combustion chamber feeding products of combustion to a discharge nozzle passage of reduced inner diameter. An axially aligned metal piece injector has a centrally disposed injection bore hole positioned upstream of the combustion chamber and is provided with particles which are fed through the centrally disposed injection bore hole with the injection bore hole opening near the entrance of the nozzle passage. The metal piece terminates in a cone-shaped section with a reduced diameter end proximate to the entrance to the nozzle passage. A knife-edge terminal face is thereby produced intersecting the injector bore hole to minimize turbulence and rotation of the stream of carrier gas containing the powder exiting the injector metal piece injection hole. An annular jet stream surrounding the gaseous jet stream is wholly or partially formed of super-heated steam such that the steam, resulting from vaporization of water droplets, acts to cool the structural components of the internal burner. The device may alternatively be constituted by a plasma torch device.

10 Claims, 1 Drawing Sheet

METHOD OF HIGH INTENSITY STEAM COOLING OF AIR-COOLED FLAME SPRAY APPARATUS

FIELD OF THE INVENTION

This invention is directed to a flame spray method and more particularly to an increase in cooling of such air-cooled flame spray apparatus.

BACKGROUND OF THE INVENTION

This invention is an outgrowth of U.S. Pat. No. 4,634,611 entitled "Flame Spray Method and Apparatus", issued Jan. 6, 1987.

In such apparatus, a flame sprayed coating is produced by combusting an oxy-fuel mixture in a duct to produce a high temperature, high velocity column, or flame jet. The jet is used to heat and propel a solid material from the duct toward the substrate. A stream of uncombusted compressed air, separate from the oxy-fuel mixture, is provided and heated above ambient temperature by flowing such a stream along the exterior of the duct while absorbing heat therefrom. The exit velocity of the flame jet is maintained subsonic while surrounding the column or flame jet with a co-axial sheath of expanded compressed air having a velocity which is sufficiently close to the velocity of the flame jet so that there is little initial mixing of the sheath and the jet.

While such apparatus and method, as set forth in U.S. Pat. No. 4,634,611, is an improvement within the developing art of flame spray of coatings for impact and solidification on a substrate, the cooling effect by the air prior to impact is less than satisfactory.

It is therefore a primary object of the present invention to produce a hot jet surrounded by a cooling sheath of a high velocity gas surrounding the hot jet with an enveloping flow of steam and effecting significantly increased cooling by evaporation of water passed over the hot surfaces of the combustion nozzle to produce the steam as an annular sheath about the flame spray jet.

DETAILED DESCRIPTION OF THE PREFERRED EMBODIMENT

Figures 1, 2:
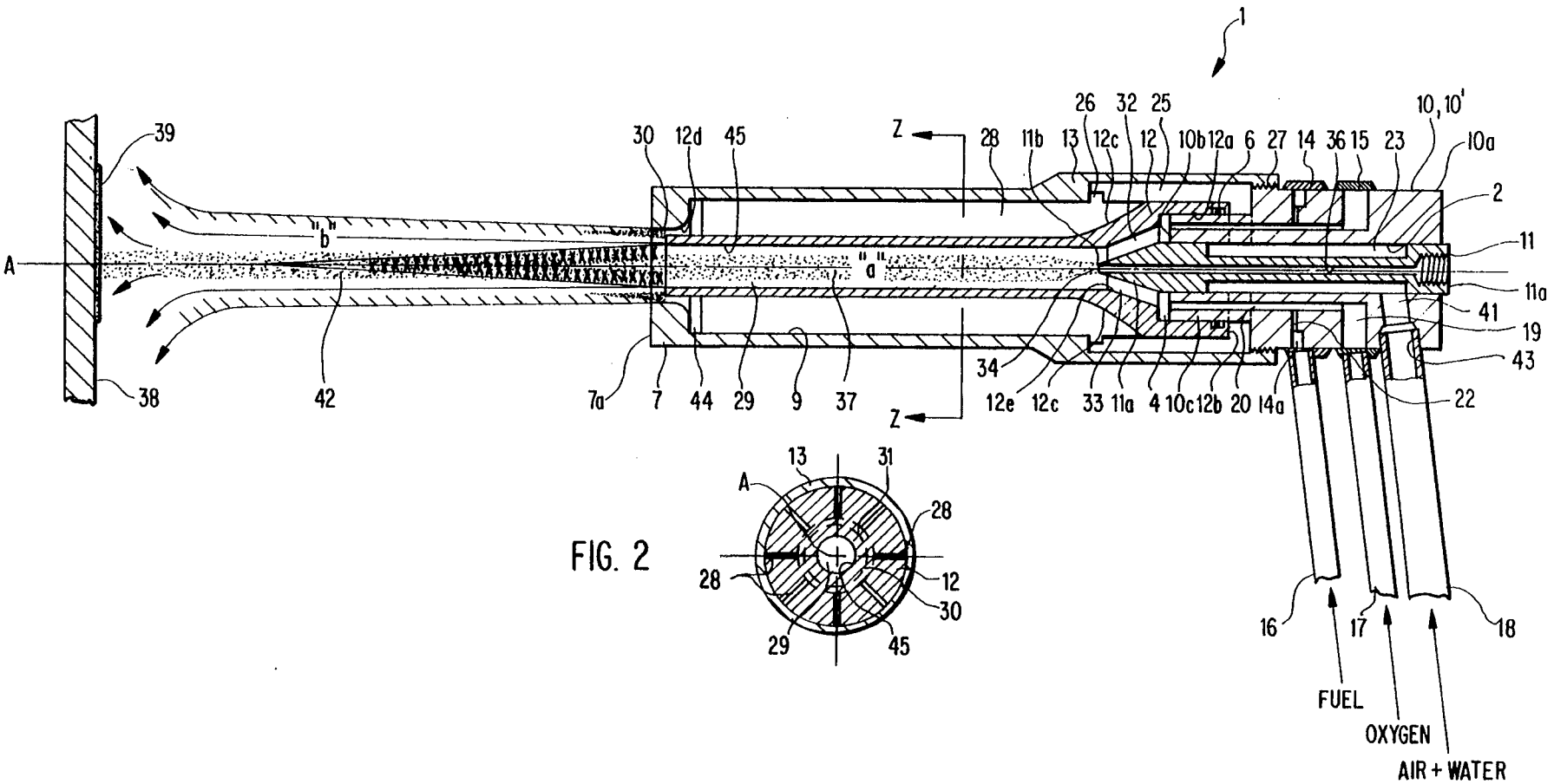
FIG. 1 is a vertical, longitudinal sectional view of an improved flame spray apparatus or device forming a preferred embodiment of the invention.
FIG. 2 is a transfer sectional view of a portion of the apparatus of FIG. 1, taken about at line Z—Z.

Referring to the drawings, FIGS. 1 and 2 show a flame spray apparatus or device indicated generally at 1, of near actual size, comprising a cylindrical body piece 10, having an axial bore 2, within which bore 2 is a coaxial inner injector 11 having radially enlarged ends 11*a* and 11*b* separated by an annular recess 3 about the periphery of the cylindrical inner injector 11. Threadably coupled to the outer periphery of the body piece 10 via threads 27 is a hollow tubular nozzle holder 13 which extends some distance beyond the end of the body piece 10 and which concentrically surrounds a nozzle or tube 12, and being radially spaced therefrom. The annular recess 3 forms an annular cavity 23 with bore 2 of the body piece 10. Seal rings 14 and 15 are provided on the body piece 10 about the outer periphery 10*a* of the body piece.

Tubes 16, 17, and 18 are connected at their upper ends to the body piece 10. As indicated by the headed labelled arrows, fuel is supplied to tube 16, the tube being coupled to seal ring 14 and received within a hole 14*a*. The tube 16 opens to an annular passage which in turn feeds the fuel through small diameter holes 22 to mix with oxygen flowing through a second tube 17. From tube 17 oxygen passes through a radial passage into body piece 10 and via a manifold 19 through six passages 20 extending parallel to the axis A of the apparatus 1. The six passages which are at the same radial distance from the axis A within body piece 10. The combustible mixture formed of fuel and oxygen passes into an annular cavity 4 defined by the radially enlarged portion 11*a* of the inner injector 11, the axial end wall 10*b* of the reduced diameter portion of the body piece 10, and an internal bore 12*a* of nozzle 12. The inlet end 12*b* of the nozzle 12 is sized to the outer diameter of a reduced diameter portion 10*c* of the body piece 10 and fitted tightly thereto and sealed by way of an o-ring 6. An intermediate portion 12*c* of the nozzle having a conical inner surface 12*e* joins the inlet portion 12*b* and outlet portion 12*d* having a smaller diameter bore 45. The intermediate portion 12*c*, defines by way of its interior conical surface 12e, and conical tip 11*b* of the inner injector 11, an enlarged converging volume 32 where the combustion mixture is ignited. The major portion of combustion of the mixture occurrs throughout the length of nozzle passage 29 over the longitudinal extent of the outlet end 12*d* of nozzle 12. The outlet end 12*d* of the nozzle forms the combustion tube of the apparatus 1.

The nozzle holder 13 is a hollow tubular member of a diameter considerably larger than that of the nozzle 12 and terminates in an outer end wall 7 provided with a relatively large axial hole or bore 30. The outlet end 12*d* of the nozzle terminates within that bore and just short of the front face 7*a* of the nozzle holder end wall 7.

The nozzle 12 is formed of a solid metal cylinder of significant length having an outer diameter equal to the diameter of counter bore 9 over a portion of the nozzle holder 13 and is provided with a radially enlarged collar 26 such that the collar 26 abuts radial shoulder 13*a* of the nozzle holder 13. A plurality of circumferentially spaced, narrow radial slots 28 are formed within the nozzle 12 over the full circumference of that member narrow, to form parallel flow passages which extend parallel to the axis A of the apparatus. The nozzle holder is radially enlarged at its end proximate to the body piece 10 to which it is threaded at 27 and forms an annular chamber 25 about the inlet end 12*b* of the nozzle.

A third tube 18, which extends generally parallel to tubes 16 and 17, also fits, at one end, into a radial hole 43 within the bottom of body piece 10 and opens to annular chamber or volume 23 via passage 41.

The headed arrow labelled "air and water" constitutes a source of air and water which enters the annular volume 23. This air and water flow functions as a coolant for body piece 10 and the annular nozzle holder 13 by passing through a plurality of circumferentially spaced radial holes 24 within the body piece 10 and communicating to an annular chamber or cavity 25. The circumferentially spaced narrow radial slots 28 open at their upstream ends to the chamber or cavity 25 defined by nozzle 12 and nozzle holder 13. In the illustrated embodiment, the narrow radial slots 28 are eight in number; however, the number of slots may readily vary. The narrow slots 28 terminate at the downstream end 12*d* of nozzle 12, short of the upstream surface 7*b* of end wall 7 so as to define with the nozzle holder 13, a narrow annular chamber 44 which extends circumferentially about tip of the nozzle outlet end 12*d*. The tip has an outer diameter which is slightly less than that of the bore 30 within the end wall 7 of the nozzle holder 13. The coolant mixture of air and water passes therefore, through a reduced diameter annular discharge passage 31 to form an annular sheath flow b surrounding the combustion jet a. The combustion jet a decreases in diameter from the tips of outlet end 12*d* of the nozzle in the direction of a substrate 38 which is positioned in the path of the flow and at right angles to the axis A of the apparatus.

The theory of operation involves the creation of a fog which results from the expansion of the coolant stream into the atmosphere of the annular cooling jet. Expansion cooling causes some of the super-heated steam contained within the coolant flow to condense forming submicron water droplets. Downstream of the outlet end 12*d* tip of the tube 29, where the outer regions of the hot jet a mixes with the cooler outerflow, the water droplets are again evaporated and effect a large cooling action in the region b of the flame flow. The inner core of hot jet flow a remains at full-peak temperature to the peak of that hot jet.

As may be appreciated, the extremely hot gases of combustion a do not impinge the workpiece 38, yet coating 39 is produced in a normal fashion. Adverse overheating of the workpiece substrate 38 is effectively prevented. Further, the outer cooling sheath b has moved an appreciable distance away from the exit end 12*d* of the sheath of the tube 29 before the particles 37 enter the mixed flow region. Particle heating, in turn, takes place all the way to point 42 where the particles leave the jet of hot gases a.

The tubular inner ejector 11 which receives the particles 37 in powder forms connected via threads 35 to an adapter (not shown). The particles 37, together with the carrier gas, flow through axial bore 36 to exit into the combustion gases at the exit hole 34 of bore 36 as defined by the truncated section 33 of the injector piece 11. It has been determined that the exit hole 34 of small diameter through which the particles 37 within the carrier gas are discharged should be formed with a minimum of injector piece solid face surrounding that exit hole 34. The best exit for the particles is at a knife edge as shown. In this way, the carrier gas blends without the formation of eddies or undesirable turbulence into the combustion gas stream passing through the annular conical chamber or volume 32, about the truncated conical section 33 of the inner ejector piece 11. Radial motion impartation to the flow is avoided, and the particle flow remains centrally located as evidenced at 37 throughout the nozzle passage 29, thus eliminating a particle buildup on the inner wall, i.e., a bore 45 of the nozzle 12.

As an example, under normal flow conditions, the burning of 900 scfh of oxygen (with a fuel gas such as propylene), only 2 to 3 pounds per minute of water are required to produce the beneficial effects of the steam cooling of the steam generation by heat transfer to the water content of the coolant flow. Each pound of water absorbs about 1,000 btu release from a combustion of the fuel and oxygen mixture internally of nozzle 12, that heat release into the walls of the tube or nozzle 12 facilitating absorption of the thermal energy by the water. Additional heat is absorbed in the conical tip or section 33 of the inner injector 11, as well as the downstream face 10*b* of body piece 11 defining the exit plane of passages 20.

Usually this heat flow, into the combustion device elements, is normally carried away by a cooling flow of water which constitutes lost heat. In the present invention, it is this heat which turns the water content of the coolant stream to steam. The steam, in turn, provides a large coolant flow together with its entrained air to keep the workpiece at a reasonable temperature during spraying. In addition, the enlarged sheath b flow adds momentum to the total flow and increases particle impact velocities against the workpiece 38 to form a denser coating 39.

While the illustrated embodiment uses a powder with the particles 37 heated and impacting against the workpiece 38, a wire or rod can be fed through the fine diameter passage 36 to be heated and atomized by the combustion flow passing through tube 29 and beyond the exit or outlet end 12*d* of that nozzle.

For 900 scfh oxygen burned, the total heat released by combustion in the Example is about 450,000 btu per hour. An amount of heat equivalent to around 25% of this total is lost to the containing walls of the apparatus 10. The loss amounts to 112,000 btu per hour or 1875 btu per minute. For this example, 1 to 1 and ½ pounds of water per minute (together with about 40 scfm of air) are sufficient to provide the necessary cooling. The water, turned to steam, has a volume of about 39 scf. The total coolant flow is 79 scfm, and this flow contains about half the oxygen content of the air-alone coolant or the surrounding atmosphere. The result is less oxidation of the spray area on the workpiece which is effectively blanketed by the low oxygen flow.

The steam mixed into the air flow and into the surrounding atmosphere is at very low partial pressure and does not condense on the workpiece.

The invention therefore provides a high velocity envelope of steam surrounding the combustion jet and the entrained spray particles. It is convenient to provide this steam by mixing the correct amount of water into a compressed air flow and to use the resulting mixture as the coolant. Pure steam or water could be provided to the torch without the use of compressed air. However, the equipment becomes more complex and a steam generator is necessary. Water alone reduces the overall momentum of the annular sheath surrounding the flame jet, and it is difficult to design a cooling system possessing no hot spots.

It should be appreciated that the principles of the invention, as described and claimed herein, apply equally to other types of flame spraying methods and apparatus. For example, the benefits of controlling workpiece overheating and/or oxidation of the coating often experienced in plasma spraying can be controlled by surrounding a plasma jet stream with an annular sheath, at least partly or wholly, comprising superheated steam. The same is equally true for twin wire-arc devices.

In some cases, it is convenient to feed a liquid water spray into the hot gases surrounding the flame spray cone with the water droplets vaporizing in the hot gas flow providing the needed and desirable cooling. For example, air film cooling of a plasma spray torch is to date inadequate. Yet, the introduction of water into the plasma jet peripheral zones, in accordance with this invention, constitutes a very effective technique to keep the workpiece cool in spite of impact by the hot particles to create the fusion build-up of the coating 39. Such flame spray coating 39 is preferably formed of particles of a suitable metal which if not molten fuse as a result of increase in temperature upon impact against the substrate 38.

While the invention has been particularly shown and described with reference to a preferred embodiment thereof, it would be understood by those skilled in the art that various changes and details may be made without departing from the spirit and scope of the invention.

What is claimed is:

1. In a method of flame spraying a coating on a substrate comprising:

combusting an oxy-fuel mixture in an internal burner and discharging products of combustion through an exit nozzle as a gaseous jet stream, feeding particles into said jet stream for entrainment and heating and directing said jet stream against a surface to be coated downstream of the exit nozzle, and providing an annular jet stream to surround said gaseous jet stream and move coaxially with the gaseous jet stream such that a total flow of both jet streams increases in momentum, the improvement comprising forming said annular jet stream, at least in part, of super-heated steam for enhanced cooling of said products of combustion gaseous jet stream.

2. The method as claimed in claim 1 wherein the step of forming the annular jet stream, at least in part, of super-heated steam comprises applying water to structural components of the internal burner to turn the water into steam.

3. The method as claimed in claim 2 wherein the step of applying water to the structural components of the internal burner comprises supplying water in a compressed air flow against said structural components.

4. The method as claimed in claim 1 wherein said step of providing an annular jet stream at least in part of a super-heated steam comprises providing said steam to the internal burner from a separate steam generator.

5. The method as claimed in claim 4 further comprising separately cooling the internal burner with steam from said steam generator.

6. The method as claimed in claim 1 further comprising the step of confining the steam within said combined jet streams in a sufficiently small volume to preclude condensation of steam on the substrate.

7. The method as claimed in claim 1 wherein the step of entrainment of heated particles into the jet stream comprises introducing into the jet stream a spray material in wire or rod form.

8. In a method of spraying a substrate by effecting combustion of an oxy-fuel mixture in an internal burner combustion chamber, discharging products of combustion through a nozzle to form a jet stream and introducing a material to be sprayed into said jet stream, the improvement comprising concentrically surrounding said jet stream by an annular jet stream composed, at least in part, of super-heated steam flowing in the direction of flow of the jet stream exiting from an exit end of said nozzle thereby creating a total flow of both the annular jet stream and an internal axially positioned jet stream from said exit nozzle of said internal burner having increased momentum and with cooling by evaporation of water forming said superheated steam by contact of the annular jet stream with the jet stream exiting from the exit end of said nozzle.

9. A method for decreasing oxidation of a coating formed by impacting said coating on a substrate by a flame spray, said method further comprising the step of introducing super-heated steam to a combustion produced jet stream propelling heated particles against said workpiece as an annular stream of a flow having an active molecular oxygen content less than that of atmospheric air.

10. The method as claimed in claim 9 wherein said step of propelling heated particles against said workpiece includes introduction of material in powder form to said combustion product.

* * * * *